United States Patent [19]

Wimberley

[11] Patent Number: 4,583,907

[45] Date of Patent: Apr. 22, 1986

[54] EXTENSIBLE APPARATUS

[76] Inventor: Ronald J. Wimberley, P.O. Box 3000 F, Harbor, Oreg. 97415

[21] Appl. No.: 611,732

[22] Filed: May 18, 1984

[51] Int. Cl.[4] ..... E02F 3/34

[52] U.S. Cl. ..... 414/718; 414/706; 414/685; 414/917

[58] Field of Search ..... 414/733, 917, 685, 718, 414/706, 632; 248/277, 585, 586; 187/18, 8.71, 8.72; 74/521; 182/2

[56] References Cited

U.S. PATENT DOCUMENTS 2,865,523 12/1958 Morrison ..... 414/733
3,470,981 10/1969 Huxley, III ..... 414/917 X

FOREIGN PATENT DOCUMENTS 656181 1/1963 Canada ..... 414/718
2902279 7/1980 Fed. Rep. of Germany ..... 414/718

*Primary Examiner*—Terrance L. Siemens
*Attorney, Agent, or Firm*—Wofford, Fails & Zobal

[57] ABSTRACT

Highly flexible extensible apparatus for employing an end-use work tool for one of multiple purposes characterized by combinations of a pivotal base; main support structure; pivotally mounted support structure; extensible base unit having first and last respective pairs of booms and levers; attachments for the work tool; and a plurality of extension units each comprising respective pairs of booms and levers. Preferably, the base comprises an upper base plate that is rotatably mounted on a lower base plate to afford 360° of rotation. In a still more flexible embodiment, a second pivotal support structure can be employed at the end of the extensible apparatus extending from the first either fixed or pivotally mounted support structure. Respective extensible units such as hydraulic rams are preferably employed for extending and changing the angle of support of the main boom.

36 Claims, 14 Drawing Figures

EXTENSIBLE APPARATUS

FIELD OF THE INVENTION

This invention relates to extensible apparatus. More particularly, it relates to a pivotally mounted, multi-segment extensible boom apparatus that can be employed in a variety of azimuthal and altitudinal angles and elevations for any one of a variety of purposes and employing any one of a variety of end-use work tools.

BACKGROUND OF THE INVENTION

It is known to use booms to provide a means to hold or support an object at an extended distance from a particular location. Conventional telescopic, or extensible, boom construction is limited because of the requirements for long massive section lengths, multiple extension means and other elements which necessitate massive structures that are hard to stabilize on mobile machinery. In the past, particularly in the large type extensible apparatus such as used in materials handling or logging industry, large oil volumes and resultant necessary horsepower have been necessary to achieve satisfactory telescopic extension and retraction speeds. Moreover, the prior art extensible grapple apparatuses, such as employed in the logging industry for example, have been limited to a reach of between 4 and 15 feet and have weighed between 3500 and 12,000 pounds. Because of their limited extensibility and because they were too heavy on steep terrain, they have not been totally satisfactory to providing a highly flexible, multi-use extensible apparatus that can be employed for automatic grapple logging or for using other work tools.

Several patents have been examined that were allegedly pertinent. Of these, the following patents were deemed not to be really close in terms of technical content: Pat. Nos. 2,865,523; 3,252,542; 3,557,967; 3,703,903; 3,708,037; and 3,828,939. One patent was found to be pertinent. That patent is U.S. Pat. No. 4,053,075 pertaining to a high lift mounting means for loader buckets, for use with Caterpiller tractor or the like. This loader is pertinent in providing a vertically extensible loader bucket made possible by double acting hydraulic cylinders that are pivotally interconnected. The approach is vastly different and the structure is vastly different from this invention, however; and the invention of U.S. Pat. No. 4,053,075 could not be employed at the variety of azimuthal and altitudinal angles with the variety of work tools that this invention enables.

SUMMARY OF THE INVENTION

Accordingly, it is an object of this invention to provide economical, highly flexible extensible apparatus that can be employed at a plurality of respective angles for any one of a plurality of end-use purposes and with any one of a wide variety of end-use work tools.

Specifically, it is an object of this invention to provide a highly flexible extensible apparatus that can be pivotally mounted on any desired vehicle for performing any desired end-use work in the field of material handling or the like and that can be extended in any azimuthal or altitudinal angle for performing the remote work.

It is a specific object of this invention to provide a highly flexible extensible apparatus that can employ pivotal support structure in a multiplicity of respective angles supporting the extensible unit to reach over an obstacle or the like and otherwise fulfill the foregoing objects.

These and other objects will become apparent from the descriptive matter hereinafter, particularly when taken into conjunction with the appended drawings.

In accordance with one embodiment of this invention there is provided an extensible apparatus that is adapted for employing an end-use work tool for any one of multiple purposes. This embodiment comprises a base and a main support structure fixedly connected with the base. A pivotally mounted support structure is mounted on the main support structure and has angle of support for cantilevered structural levers and booms. An extenisble means is provided for pivoting the pivotally mounted support structure so as to change the angle of support and hence the elevation angle at which the apparatus is extended. The extensible means is connected with the support structure and with the pivotally mounted support structure for this purpose. At least one pair of respective first boom and first lever have their respective near ends pivotally connected with the support structure such that pivoting of the pivotally mounted support structure changes the relative positions of their rear end so as to effect the angle of support. The first boom has a remote lever pivot point adjacent its remote end for connected with a subsequent lever. The first lever has a remote lever pivot point for connection with an intermedite fulcrum point of a subsequent lever and has intermediate the near end and the remote end pivot point an intermediate boom pivot point for connection with a subsequent boom. A second extensible means is provided for changing angle of the first boom and the first lever with respect to the pivotally mounted support structure. An ultimate lever having a near end pivotally connected with a remote lever pivot point of the preceding boom has a remote end work tool pivot connection for a connection with the work tool. Intermediate fulcrum pivot points are connected with the remote lever pivot point of the preceding lever such that a plurality of pairs of levers and booms can be inserted as desired to obtain the necessary reach. An ultimate boom having a near end pivotally connected with the intermediate boom pivot point of an immediately preceding lever is provided and has a remote end work tool pivot connection for connection with the work tool. Means are provided for connecting the work tool with remote ends of the ultimate boom and lever.

In accordance with another embodiment of this invention, there is provided, in addition to the base, support structure and first and last, or ultimate, respective booms and levers, a plurality of extensible extension units that are interconnected with each other and with the respective first and last booms and levers so as to form respective scissor interacting parallelograms that can be extended to take the necessary load and that have substantially identical respective booms and levers such that they can be readily assembled to any desired length without complex warehousing requirements or assembly skills needed.

In still another embodiment of this invention, there is provided a pivotally mounted extensible apparatus that has, in addition to the base unit, the first and last booms and levers, the respective support structure, with or without the extension units, lower and upper base plates that are pivotally mounted with respect to each other for rotation about a pivot shaft with the upper base plate supporting the main support structure to increase the azimuthal flexibility of the unit which already has exceptionally high degree of altitudinal flexibility.

With the apparatus of this invention, the extension can be for any length up to 100 feet or more due to the lightweight material used in construction of the respective elements.

Preferably, the respective extension means comprise hydraulically operated cylinders and the pivotal action is preferably accomplished with a hydrostatic motor employing high pressure hydraulic fluid to power the motor which, in turn, powers a pinion gear engaging circular rack gear teeth for rotating to a desired azimuth.

BRIEF DESCRIPTION OF THE DRAWINGS

FIG. 10 is a line schematic illustrating use of multiple units in one embodiment to achieve reaching over an obstacle or the like.

DESCRIPTION OF PREFERRED EMBODIMENT(S)

It should be borne in mind that this invention is highly flexible and readily adaptable to do any of a multiplicity of different types of jobs. As such, it can be mounted on a plurality of different kinds of platforms, including different kinds of mobile equipment; such as, rail car flatbeds, trucks, off-road equipment, or the like.

It should be borne particularly in mind that this invention may range from single respective levers and booms for lightweight straightforward jobs to combinations, including two or more laterally displaced respective levers and booms, for greater stability for heavier structures and heavier jobs.

Figure 1:
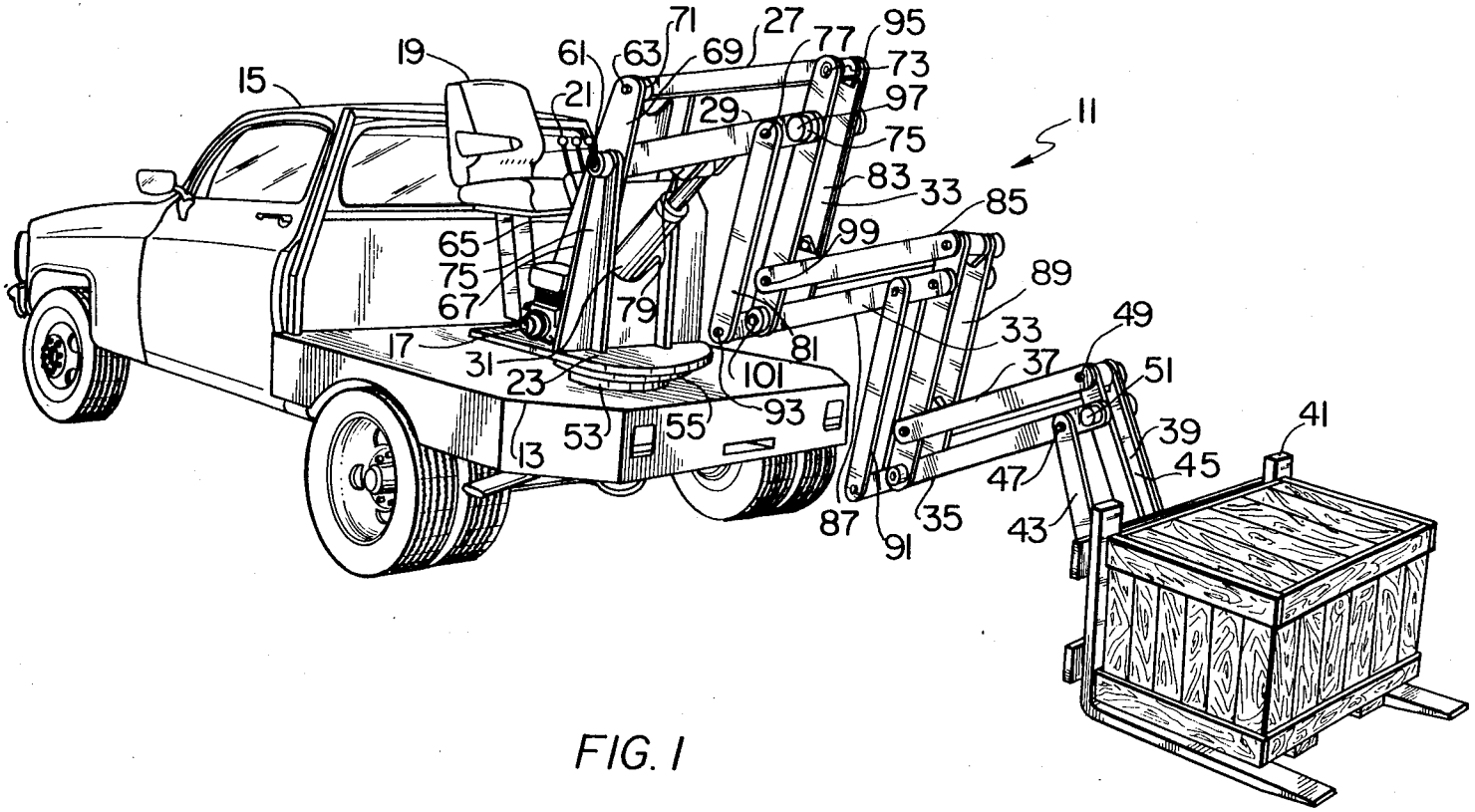
FIG. 1 is a perspective view of one embodiment of this invention, showing work tool levers and booms.
Figure 4:
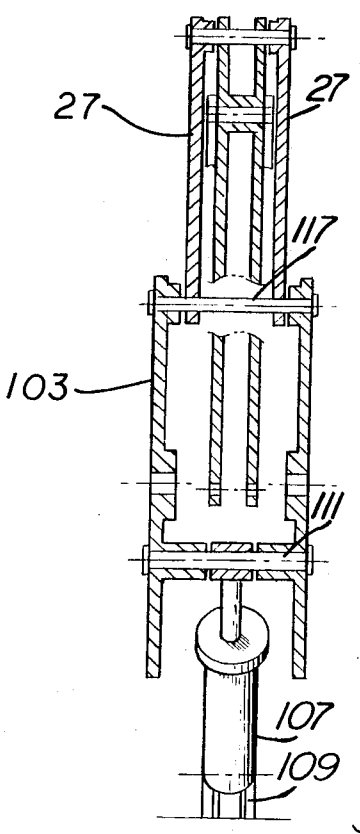
FIG. 4 is a partial cross-sectional view, partly broken away, showing the rear of the embodiment of Fig. 2.
Figure 3:
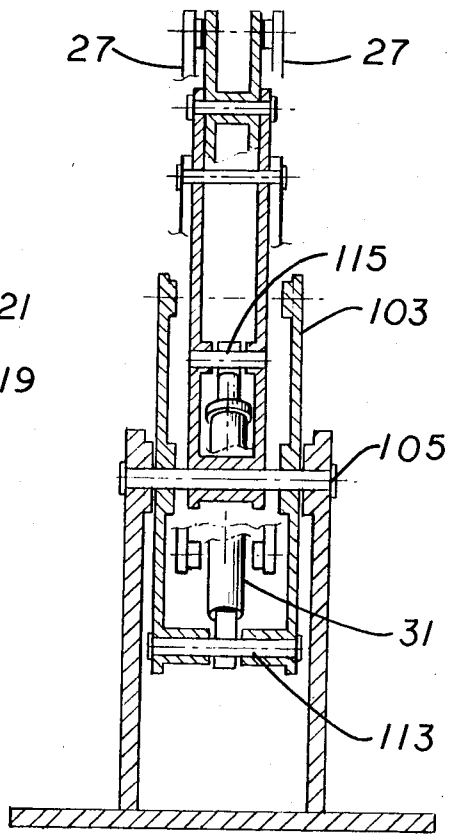
FIG. 3 is a partial cross-sectional view, partly broken away, showing the front of the embodiment of FIG. 2.

Referring to FIG. 1, the extensible apparatus 11 is shown emplaced on the rear bed 13 of a truck 15. As illustrated, the apparatus 11 has its own self-contained power source 17 in the form of an air cooled engine powering a hydraulic pump for a hydrostatic power system for operating the respective hydraulic rams and motors that will be described later hereinafter. These elements effect the desired azimuthal and altitudinal angles, as well as the degree of extension or retraction desired by the operator who sits in the seat 19 operating controls 21. The respective interconnecting conduits and the like for the hydrostatic elements such as the motors and hydraulic rams are conventional, well recognized, and need not be described in detail herein. Consequently, for clarity they have been omitted from the illustrations.

The apparatus 11 comprises a base 23, main support structure 25; at least one pair of respective first boom 27 and first lever 29, extensible means 31 for changing the angle of support of the first boom and first lever 27, 29 for effecting the extension and retraction of the extensible apparatus; a plurality of extension units 33, an ultimate lever 35, ultimate boom 37 and a means 39 for connecting the work tool with the remote ends of the ultimate boom and lever.

As illustrated, the work tool is a cargo lift 41 and the means 39 comprises respective work tool booms 43 and work tool levers 45 connected intermediate the work tool and the ultimate levers and booms 35, 37; with the work tool boom being connected at its near end with the remote boom pivot point 47 of the preceding lever 35 and with the work tool lever 45 being pivotally at its near end with the preceding boom at its remote end work tool pivot connection 49 and having an intermediate fulcrum pivot point 51 that is connected with the remote lever pivot point of the preceding boom. With the illustrated structure the cargo lift can be maintained oriented correctly by hydraulic extension means to keep the cargo safely emplaced thereon while it is moved through an extended range of altitudinal and azimuthal angles to ultimate deposition. In the illustrated embodiment, the detailed description concerns single lever interconnections; but it is to be understood that where two or more levers are emplaced, the same respective interconnections are employed with respect to each of the interconnecting and interacting booms and levers.

Figure 13:
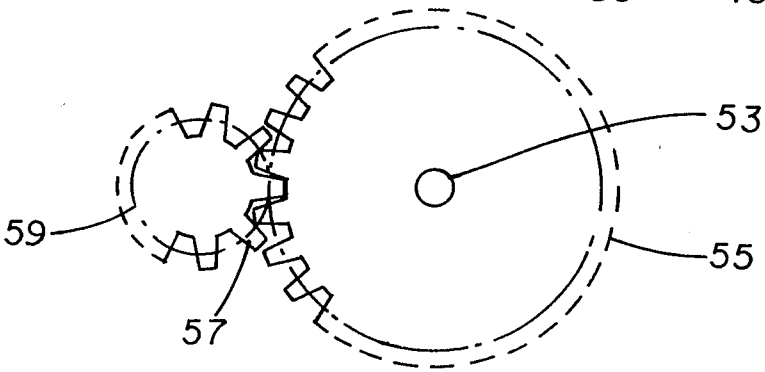
FIG. 13 is a plan view of a suitable pinion gear engaging a circular rack for effecting the 360° pivotal movement of an embodiment of this invention.

The base 23 must have adequate structural strength to retain proper orientation of the cantilevered extensible apparatus 11 and any end-use work tool and object on which work is being performed. Consequently, it is ordinarily made of strong structural metal such as steel or the like. Preferably steel is employed since it is easily welded, although other materials such as thick aluminum plate or the like could be employed. In this invention there is no need for exotic and difficultly worked metals such as titanium, magnesium or the like although they could be employed. While the base may be stationary, it is preferably a pivotal base with a lower base plate 53 that is fixedly mounted to the stable platform such as the bed 13 of the truck 15 and with a pivotally mounted upper base plate 55 that is pivotally rotatable throughout 360° of rotation about a pivot shaft 53, FIG. 13, interconnecting the respective upper and lower base plates 53,55. As can be seen in FIG. 13, suitable circular rack 55 has gear teeth that engages with teeth 57 on a pinion gear 59 that is powered by hydrostatic motor (not shown) that is part of the power source 17. Thus, as the gear 59 is rotated and is affixed to the upper base plate 55, it causes the movement about the lower plate 53 to any desired azimuthal orientation. This is responsive to operation of the controls 21 by the operator in seat 19 and orients the main support structure 25 for lateral or altitudinal extension.

The main support structure 25, similarly, is structurally strong to support the respective pivotal mounting shafts 61, 63 that will support the pivotally mounted near end of the respective first lever 29 and first boom 27. As illustrated, the main support structure comprises a pair of vertically oriented structurally strong members 65 made of steel or other strong metal and braced with laterally extending members 67, also structurally strong plate steel. If desired, separate vertically extending members 69 can be employed for supporting the upper shaft 63.

Again, herein the discussion is concerned with single support members and shafts for easy understanding; but it should be remembered that a pair or more may be employed for pivotal mounting of the respective first booms and levers. Any other suitably structurally strong main support structure can be employed as long as the design allows freedom of movement of the respective elements for effecting the desired angularity and extension and retraction, such as effected by pivotal movement of the first boom 27 and the first lever 29.

The first boom 27 is a suitably strong structural member. It may be in the form of tubular member such as pipe or the like. Preferably, it is of rectangular cross-section for greater strength and inertia in one design plane than in another. The strength will be appropriate to the ultimate use. For example, heavy duty levers formed of steel or the like will be employed for heavy jobs whereas lighter weight levers can be employed in lighter jobs. Each first boom has its near end 71 pivotally connected with the support structure 25, as by way of shaft 63 in member 69 such that it can be pivoted and its support angle changed with respect to the support structure. The first boom 27 has a remote lever pivot point 73 having its respective shaft for connection with a subsequent lever.

In a converse arrangement, the first lever 29 is adapted for connection with a subsequent boom. Specifically, the first lever 29 has its respective near end pivotally connected with the support structure, as by way of shaft 61 such that it can be pivoted and its support angle changed with respect to the support structure 25. The first lever has a remote lever pivot point 75, at its remote end, that is connected with the near lever pivot point of the next lever and has a remote intermediate boom pivot point 77 for connection of a subsequent boom. The first lever, similarly as with the first boom is structurally strong in order to be able to take the stress induced when operating under an extended condition, such as effected by extensible means 31.

The extensible means 31 may comprise any form of extensible means, such as a screw-type jack or the like, as long as it will develop adequate power. Preferably, a hydraulic ram is employed as the extensible means 31. The ram is thus positionable by means of a four-way control valve responsive to the control levers and the hydraulic pressure in accordance with conventional technology. As illustrated, the rod of the ram is connected with the first lever at extension point pivot connection 79. It is relatively immaterial whether the first lever or the first boom is connected via the pivot connection 79. In the illustrated embodiment, two laterally displaced levers are employed so that they are structurally stronger and preferable to connect with the extensible means 31 rather than connect the ram intermediate the main support structure and the boom 27. As will be recognized, the hydraulic ram is pivotally mounted such that it can pivot somewhat relative to the near end of the first lever 29 as it raises and lowers the remote end to change the angle of support of the extensible apparatus 11. As is recognized, suitable hydraulic pressure is applied to an interiorly mounted piston connected with a rod that is pinned via a shaft to the levers. The cylinder is also pivotally mounted at the base 23. Suitable hoses supply pressure to the respective ends of the hydraulic ram, although they are not shown in FIG. 1.

In the discussions herein, it is assumed that one of average skill in the art will be aware of the various types of constructions employing bushings, shafts, grease fittings and the like for easy interconnection of the respective pivot connections on the respective booms and levers. Accordingly, the details of these interconnections are not supplied herein. Firstly, they are conventional and secondly they will vary with the design.

Figure 11:
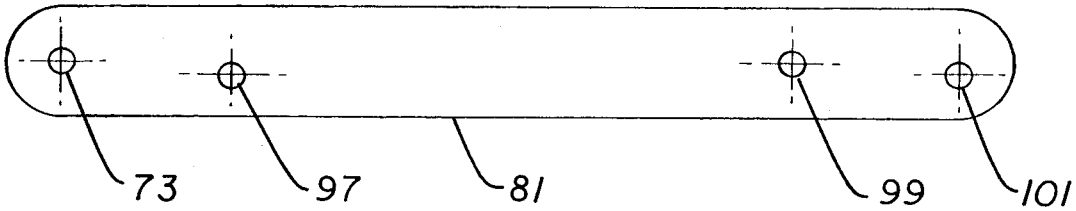
FIG. 11 is a plan view of one embodiment of the lever of this invention.

The plurality of extension units may comprise as many subcombinations of booms and levers as needed. Respective booms and levers of the respective extension units, similarly as with the first boom and lever are suitably designed to support the load that they will have to bear in doing the work of the particular job. Each of the extension units 33 comprises a next lever and next parallel boom, which will become clearer from the detailed description immediately hereinafter. In FIG. 1, the first extension unit is pivotally connected at its near end with the remote end of the first boom and lever and includes a second boom 81 and a second lever 83. This pair of respective booms and levers are then connected with a third boom 85 and the third lever 87. The respective third booms and levers are then connected with the fourth lever 89 and fourth boom 91, respectively. The fourth boom and lever are, in turn, connected with the ultimate lever and boom 35, 37. Obviously, many more extension units can be interposed if desired for a much greater reach. The details of the respective next booms and next levers of the respective extension units will become clearer from a consideration of FIGS. 1, 11, and 12. Specifically, the next boom such as second boom 81, FIG. 1, is pivotally connected at its near end with the respective boom pivot point 77 of the immediately preceding lever, which is first lever 29 in FIG. 1. It is connected near the remote end thereof at the remote intermediate boom pivot point 77. This "next boom", illustrated as second boom 81, has a remote lever pivot point 93 that is connected with the near end of the next lever, shown as third lever 87 in the illustrated embodiment of FIG. 1.

Figure 12:
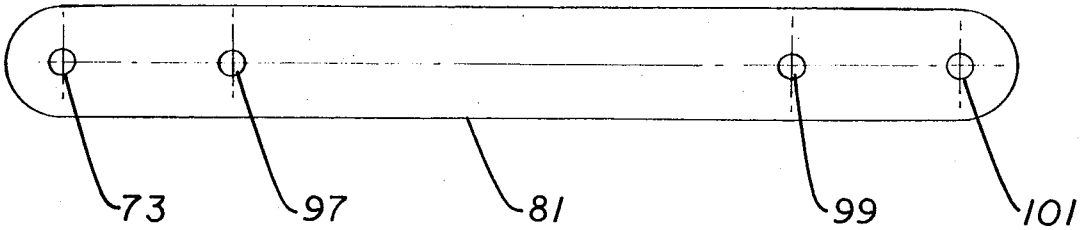
FIG. 12 is a plan view of another embodiment of the lever of this invention.

The next lever, illustrated as second lever 83, is pivotally connected at its near end 95 with the remote end of the respective immediately preceding boom, being first boom 27 in FIG. 1. This "next lever" has a near lever pivot point 97 that is connected with the remote lever pivot point 75 of the preceding lever, or first lever 29. Each next lever, such as second lever 83, also has a remote boom pivot point 99 that is connected to the next preceding boom at its near end. Each lever, such as second lever 83 also has a remote lever pivot point 101 that is connected to the next succeeding lever so as to effect the respective scissor interacting parallelogram action for proper extension. The respective apertures for receiving suitable pivot shafts, illustrated in FIGS. 11 and 12 by 73, 97, 99 and 101 can be aligned in a straight line, for example, along the central longitudinal axis of the lever 81, in FIG. 11; or they can be offset with two or more of the holes not in alignment with two or more of the other holes, as illustrated in FIG. 12. It is imperative, however, that the placement of the respective apertures be such that the requisite forces that are induced at the respective interconnection points, or pivot points, can be tolerated without distortion of the lever.

In operation, the truck 15 is emplaced at a desired site. The operator then cranks the engine to start driving the hydrostatic pump in power unit 17 for supplying power to the suitable controls 21, the extensible means 31 for extension, and the hydrostatic motor powering the pivot gear for achieving desired azimuth angles. The respective booms and levers will have been interconnected with the work piece, such as the cargo lift 41. Ordinarily, the unit is transported in the retracted position such that there is less likelihood of swaying or the like. Accordingly, the operator then extends the unit to pick up the cargo and move it both azimuthly and altitudinally to a new reposing position, as from a freight car onto a truck, from a ship onto a dock or the like. When all of the cargo moving, or material handling is done, the operator can then restore the unit to its retracted position, turn off the power unit 17 and drive to a new location. In the illustrated embodiment, lateral sway is minimized by using a plurality of respective booms and levers for increased stability in the vertical plane when the plane of the extension units are vertical. Because of this stability, the extensible apparatus 11 can be employed even on an inclined surface such as on the side of a railroad track or the like. It is preferable, however, to employ it on relatively level surfaces when the cargo lift is employed to engage relatively level cargo. Additional flexibility can be achieved with inter-posing of a hydraulic ram into the work tool connections, as will be clear from FIGS. 7–9 later hereinafter. As will become clear from the other embodiments described hereinafter, this unit has exceptional flexibility so as to be adaptable to working in remote terrain such as logging terrain or the like.

Referring to FIGS. 2–6, there are illustrated other embodiments of this invention, although elements shown in FIGS. 1 and 13 are omitted from these Figures for clarity.

Figure 2:
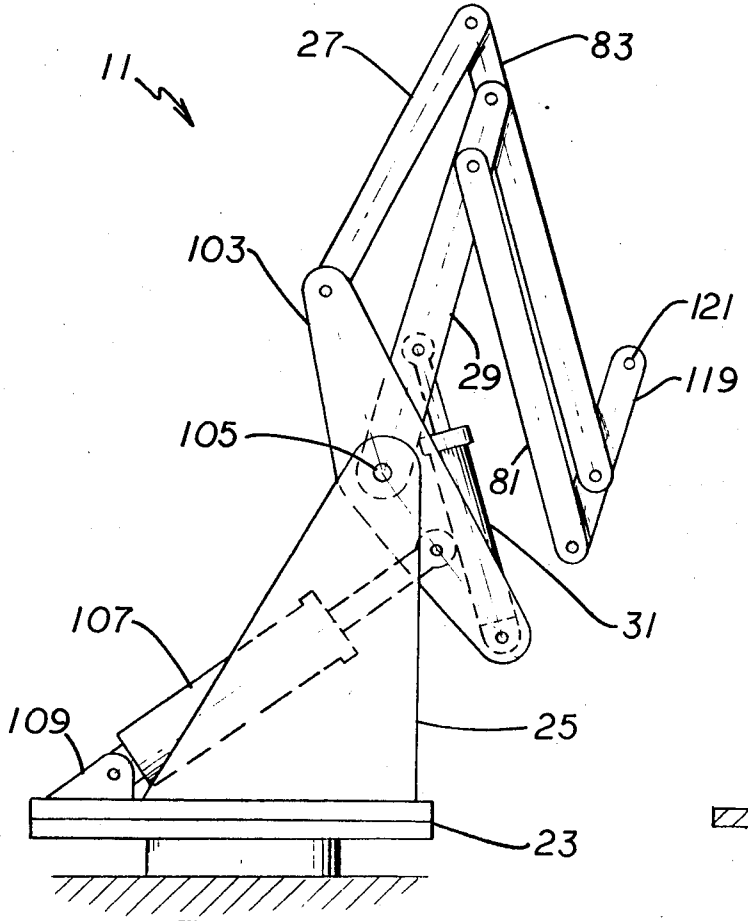
FIG. 2 is a partial side elevational view, partly schematic, of another embodiment of this invention that also shows a work tool lever for affixing a work tool.
Figure 5:
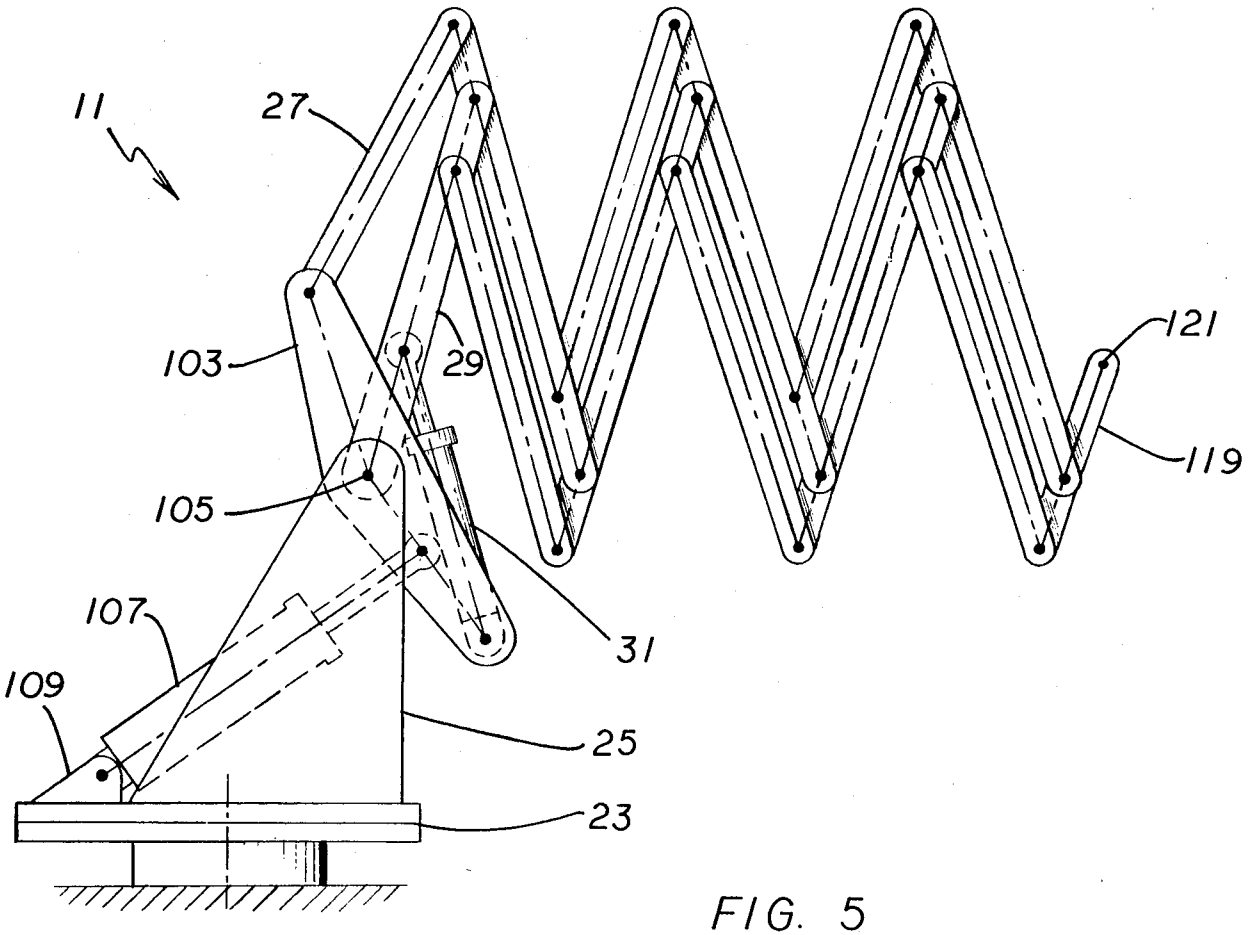
FIG. 5 is a partial side elevational view, partly schematic to illustrate the principle of this invention with the extension units in place, and also shows a work tool lever for affixing a work tool.

Referring to FIGS. 2 and 5, the extensible apparatus 11 comprises the base 23 and the main support structure 25. In the embodiment of FIGS. 2 and 5, however, there is included a pivotally mounted support structure 103 that is pivotally mounted on the main support structure and has an angle of support for cantilevered structural levers and booms. The pivotally mounted support structure has adequate structural strength, just as did the main support structure 25, but is pivotally mounted for pivotal movement around a pivot shaft 105 protruding through the upperwardly extending main elements of the main support structure 25. In this illustrated embodiment, the first boom 27 and first lever 29 have their respective near ends pivotally connected with the support structure such that pivoting of the pivotally mounted support structure 105 changes the relative positions of the respective near ends so as to affect the angle of support and hence effect extension and retraction. Expressed otherwise, it is relatively immaterial whether both of the near ends are connected to the pivot structure per se or whether one is also connected with the main support structure 25, as long as pivoting of the pivotally mounted support structure 103 can affect the relative position of the near ends of the respective first boom and first lever for affecting the angle of support of the extensible boom formed by the respective booms and levers. An extensible means 107 is provided for pivoting the pivotally mounted support structure so as to change its angle of support. The extensible means is pivotally connected with the support structure at a distance from the pivot shaft 105 so as to have an moment arm; and is pivotally connected with the base, via a bracket 109. The extensible means 107 may comprise any suitably fast moving means for pivoting the pivotal support structure. For example, it could include a threaded jack with a rotatable nut that is internally threaded and engaging with the jack, it could include a rack and pinion; or it could include the hydraulic ram. In the illustrated embodiment the hydraulic ram is preferably employed since it is readily controllable as described hereinbefore with respect to the first extensible means 31.

The first extensible means 31 is also employed for changing the angle of the respective first booms and lever with respect to pivotal support structure 103. In this instance, the extensible means 31 is connected intermediate one of either the boom or lever and the pivotal support structure 103. For example, the extensible means 107 can be connected by way of pivotal shaft 111, FIG. 4, as well as to the bracket 109. The extensible means 31, FIG. 3, can be connected with the pivotal support structure 103 by way of shaft 113 and with the first lever 29 by way of shaft 115. As illustrated, the first boom 27 may comprise a pair of booms, FIGS. 3 and 4, that are connected pivotally with the pivot support structure 103 by way of pivot shaft 117. The pair of first levers 27 thus provide lateral stability.

Figure 6:
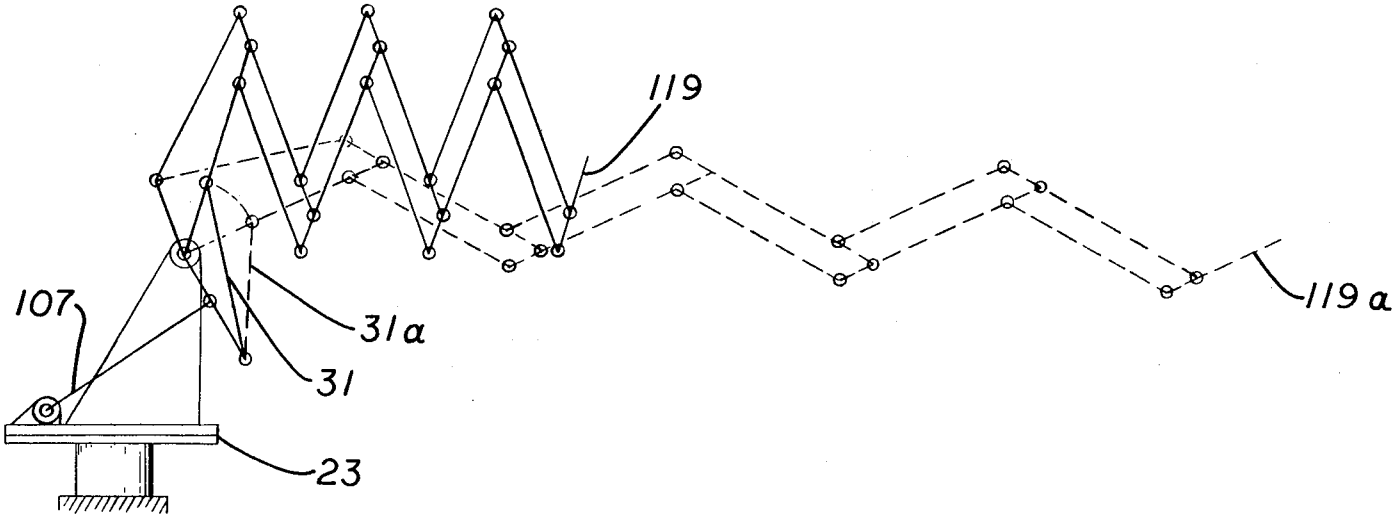
FIG. 6 is a line drawing schematic diagram showing the principle of operation of the invention of FIG. 5.

Referring to FIGS. 2 and 5, the second boom 81 and second lever 83 are interconnected as before. In the embodiment of FIG. 2, a work tool lever 119 is connected at the remote ends of the second booms and lever 81, 83 such that the parallelogram relationship is maintained. The work tool lever 119 has, in addition to its apertures for connection with the remote ends of the respective preceding booms and levers 81, 83, an end aperture 121 for connection with the work tool. The end aperture 121 thus forms a work tool pivot point. The same structure is illustrated in FIG. 5. But FIG. 5 has additional intermediate extension units such as the third and fourth booms and levers that extend its reach. The operation of the embodiments of FIGS. 2 and 5 is substantially the same as described with respect to FIG. 1. As can be seen in FIG. 6, the extensible unit 31 can retract to effect extension of the respective levers, shown by dashed lines shown by 31*a* extending the work tool lever 119 to the elongate position shown by 119*a*. Conversely, if the altitudinal angle of the extension is desired to be changed, the extensible means 107 can be extended or retracted to change the altitudinal angle. Similarly as described hereinbefore with respect to FIG. 1, the base 23 can be pivoted to change the azimuthal angle.

The respective booms and levers have configurations and structures which enable the various near ends, remote ends, fulcrum lever pivot points and boom pivot points to be pivotally pinned to their respective adjacent levers and booms with suitable shafts, bolts, bushings or the like to minimize sidewise sway. If desired, they can have bifurcated ends or may comprise dual member booms or levers as desired and as appropriately engineered. It should be apparent from the drawings that the respective distances between the pivot points are such as to afford a parallelogram action, as well as a fulcrum action on alternate booms and levers. This allows bearing loads advantageously.

It should be noted that the respective fulcrum pivot points are positioned ahead of the respective near end points of the respective levers in their closed and open positions to prevent a lock up of the boom and lever pairs. Expressed otherwise, the structure is as follows. Respective fulcrum pivot points always remain ahead, in the sense of being laterally displaced toward the work tool, of the near end pivot point of the respective levers. Similarly, the remote end pivot point of the respective levers remains ahead of the near end pivot point of the levers. Also, the remote fulcrum pivot point for connection with a near end of the next succeeding boom, is ahead of the near intermediate fulcrum pivot point for connection of the remote end of the preceding lever, just as the remote end of all lever sections at the remote end fulcrum pivot pinning point shall always remain ahead of both the near end pivot points and the boom pivot points on the levers in the extended or retracted positions of the apparatus.

In this invention, the structure thus minimizes the effect of the degree of extension; and the hydraulic ram serving as the extensible means need only overcome the effects of gravity/load ratio, friction and the weight of the boom.

Preferably, the extensible boom apparatus, excepting the first, or fixed pivot lever, have lever sections that are substantially the same length between the near end pinning point to intermediate fulcrum pivot pinning point to intermediate fulcrum pivot pinning point to remote end pinning point. This can be seen in FIGS. 11 and 12 wherein a single type of lever is illustrated. This indicates that this type lever could be used for all levers and is illustrative only. Similarly, the boom sections, exclusive of the first, or fixed pivot boom, have substantially the same length between the near end pinning point and the remote end pinning points so as to facilitate forming parallelogram linkages. These features also have the added advantage in that less skilled workmen can be employed in assembling the extensible apparatus without having to know exactly the right proportions, links, levers, booms and the like.

As indicated hereinbefore, one of the advantages of this invention is the wide variety of work tools that can be employed. Three such work tools are illustrated in FIGS. 7, 8 and 9.

Figure 7:
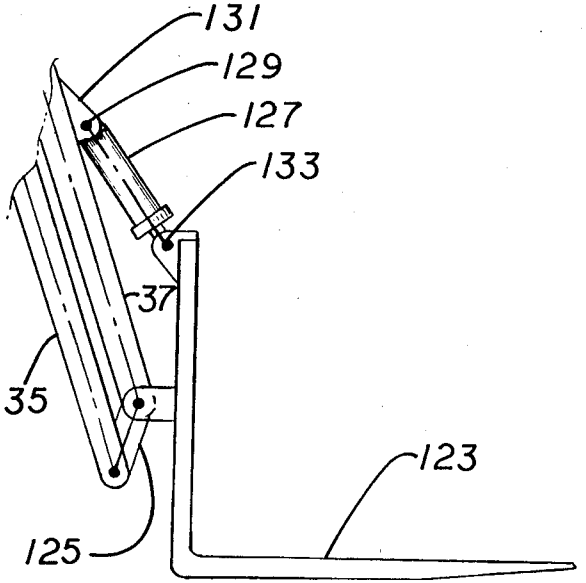
FIG. 7 is a partial side elevational view showing one method of affixing one type of work tool.

Referring to FIG. 7, the work tool comprises a cargo fork lift 123. If desired, the cargo fork lift can be connected to the respective end aperture 121 of the work tool levers 119 and manipulated as desired. In FIG. 7, however, the respective remote ends of the ultimate boom and lever 35, 37 are connected together with a pivotally mounted link 125. The fork lift means 123 is then pivotally connected with at least one of the remote ends of the ultimate boom and lever and the pivotally mounted link with an extensible means 127 pivotally connected intermediate the fork lift means 123 and at least one of the ultimate boom and lever for tilting the fork lift. Expressed otherwise, the extensible means 127 comprises a small hydraulic ram that is connected at its cylinder end by way of shafts 129 and bracket 131 and at its rod end by way of shaft 133. The respective hoses going to the cylinder end and the rod end for effecting retraction and extension responsive to suitable control lever movement is not shown, since these hoses and interconnections are well known and well within the skill of the average man in this art.

Figure 8:
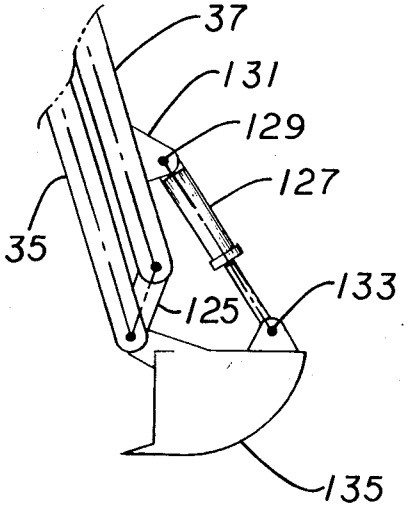
FIG. 8 is a partial side elevational view showing another method of affixing a different work tool.

Referring to FIG. 8, the work tool comprises a pivotally mounted digger 135. The connection of the pivotally mounted digger is roughly the same as described hereinbefore with respect to the forklift in that a link 125 maintains the lever and boom 35, and 37 in a parallelogram relationship with the digger being pivotally mounted to one of the remote ends of the boom and lever. Again, an extensible means 127 is pivotally connected intermediate the digger and one of the boom and lever. This allows tilting the digger at a desired angle, as for lifting swimming pool sand, gravel or the like for suitable concrete mixers or other end-uses.

Figure 9:
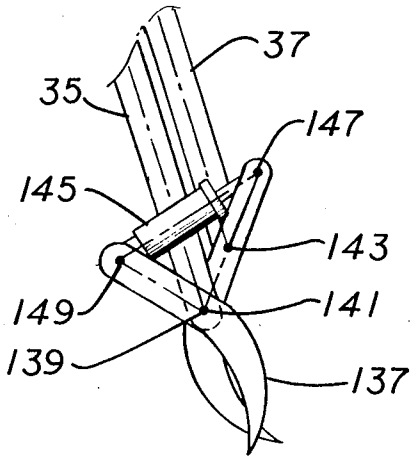
FIG. 9 is a partial side elevational view showing a method of affixing still a different work tool.

Referring to FIG. 9, the work tool comprises a pincer tool 137, as for handling logs in the forest or the like. In any event, the pincer tool has a pair of pivotally connected together jaws for gripping, pivoted about pivot shaft 139. The remote ends of the boom and lever 35, 37 are connected with one of the jaws as by pivot shafts 141, 143 so as to maintain the parallelogram relationship. An extensible means 145 is connected intermediate the respective jaws of the pincer 137, as by shafts 147, 149 for effecting opening and closing of the jaws of the pincer, as for grabbing a fallen tree or the like. Again, the extensible means 145 is operated by the control lever at the operators console adjacent seat 19.

The operation of respective end work tools of FIGS. 7–9 are well known to those skilled in this art and need not be described in detail herein. It is sufficient to note that it is preferable to employ blocking valves in the fluid flow control lines to obtain a positive liquid lock on the extension means for holding an attained position of the respective work tool during retraction or extension of the extensible apparatus 11.

Figure 10:
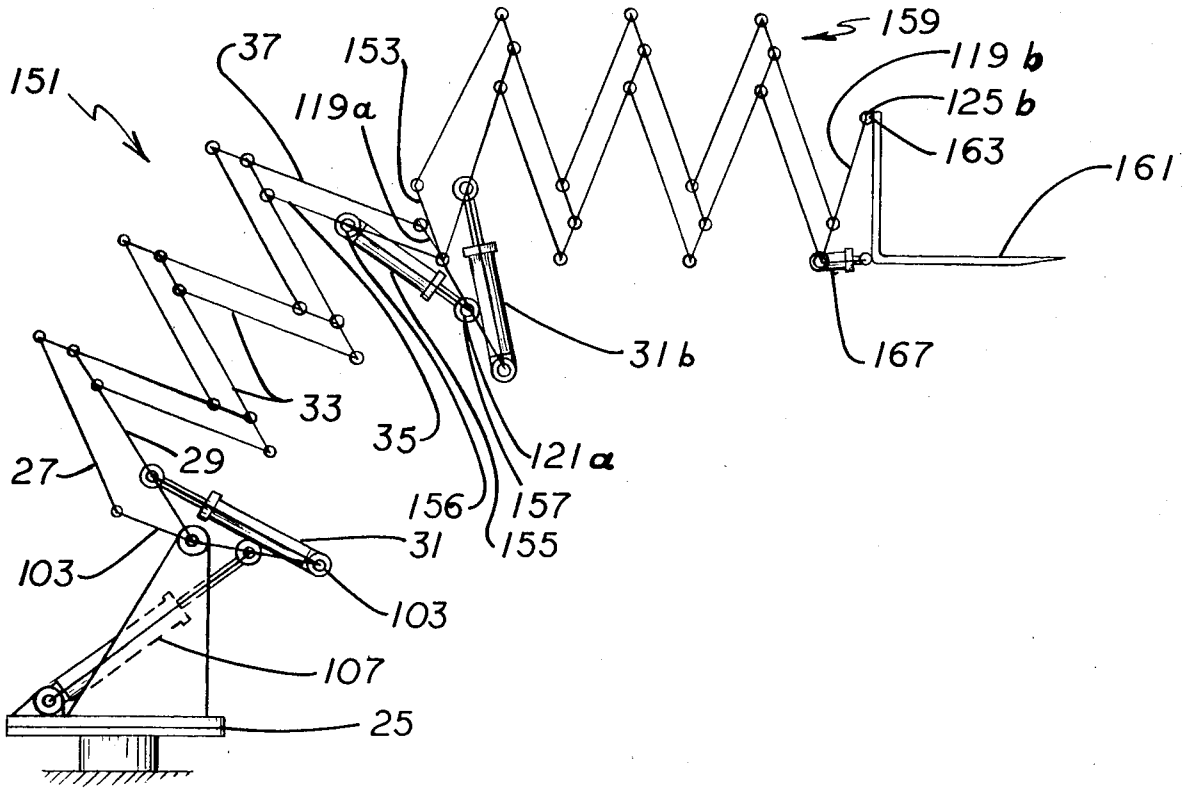

As noted hereinbefore, this invention is adaptable for exceptionally flexible operation, as by coupling a plurality of units together, as illustrated in FIG. 10.

In the embodiment of FIG. 10, the structural support 25 has the pivotal support structure 103 suitably pivotally mounted with the extensible means 107 in place for pivoting the structure. Suitable extensible means 31 is provided for effecting the extension and retraction of the respective first booms and levers 27, 29 and the extension units 33. In the first unit 151 the ultimate boom and lever 35, 37 carry at their remote end a pivotally mounted support structure 153 having its own extensible unit **31*b*. An extensible means 155 is connected intermediate the remote end aperture 121*a* on the work tool lever 119*a*, which in this instance is not carrying the work tool. In the illustrated embodiment, a second unit 159 is suitably interconnected with a pivotal support structure 153. The extensible means 155 is pivotally connected by suitable shafts 156, 157 so as to effect independent pivoting of the second pivotal support structure 153. In addition, the second extensible means 31*b* that is connected thereto can effect independent extension and retraction of the second unit 159, including as it does, the respective first booms and levers, extension unit next booms and levers, ultimate booms and levers and the work tool lever 119*b*. As illustrated in FIG. 10, the work tool may comprise a fork lift 161 that is pivotally connected at the top shaft 163 with the end aperture 125*b* of the work tool lever 119*b* with a suitable extensible unit 167 pivotally connected intermediate a suitable pivot connection on the work tool lever 119 and the work tool 161. It will become apparent from examining FIG. 10** that this dual unit can reach upwardly over an obstacle and then be extended to do the desired work.

Specifically, the operation is that the operator can tilt the first unit 151 and extend it by the respective extensible means 107 and 31 and then to suitable controls effect the desired angle of the second pivotal support structure 153 and extend its ultimate work piece 161 as desired.

Moreover, if desired, additional units can be installed for even greater reach and flexibility.

Figure 14:
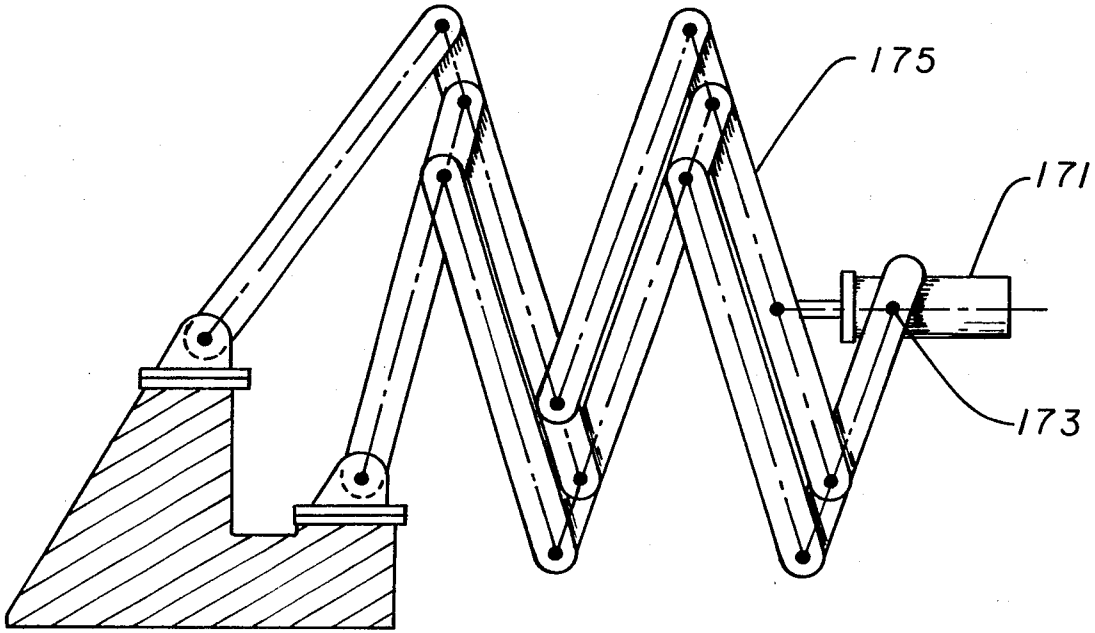
FIG. 14 is a partial side elevational view of still another embodiment of this invention.

Still another embodiment of this invention is illustrated in FIG. 14. Therein, the extensible means 171 is shown in the form of a hydraulic ram connected intermediate two levers such as a work tool lever 173 and fourth lever 175. As can be seen, when the extensible means 171 is extended or retracted, it effects extension and retraction of the extensible apparatus. Ordinarily, it is preferable to have the extensible means connected with a base plate or supporting structure.

From the foregoing it can be seen that this invention accomplishes the objects delineated hereinbefore. Specifically, it enables an economical, stable unit that can be extended at any desired azimuthal or altitudinal angle to perform remotely in any one of a plurality of jobs, such as extending from a central location out into bends or the like, loading aircraft, handling logs or other items in rough terrain.

The simplest approach of using single element levers and booms are illustrated herein. If desired, of course, bell cranks or other elements can be employed with the extensible means to impart additional flexibility.

Moreover, as many extension units as desired can be added and these extension units can be of any desired length for simplicity. One of the advantages of this invention is that the elements retain substantially the same length without having almost double length as in the convention cross-scissor arrangement. Moreover, because of the simplicity with respect to the different booms, only a few standard sizes need to be stocked in a warehouse for assembly. Similarly, the levers are relatively standard and only a few types of lever structures need be stocked. Thereafter, the respective levers and booms can be combined into a desired configuration readily and additional extension units can easily be added at a job site without the necessity of returning to a home base or the like.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. An extensible apparatus adaptable for employing an end-use work tool for one of multiple purposes and comprising:

a. a base;

b. a main support structure fixedly connected with said base;

c. pivotally mounted support structure pivotedly mounted on said main support structure and having an angle of support for cantilevered structural levers and booms;

d. a first extensible means for pivoting said pivotally mounted support structure so as to change its said angle of support; said first extensible means being connected with said support structure and said pivotally mounted support structure;

e. at least one pair of respective first boom and first lever having their respective near ends pivotally connected with said support structure such that pivoting of said pivotally mounted support structure changes the relative positions of said respective near ends so as to effect said angle of support; said first boom having a remote lever pivot point adjacent its remote end for connection with a subsequent lever; said first lever having a remote lever pivot point for connection with an intermediate fulcrum point of a subsequent lever and having intermediate said near-end and said remote end pivot point an intermediate boom pivot point connection for connection with a subsequent boom;

f. a plurality of extension units connected with said first boom and lever, each said extension unit comprising a next lever and next parallel boom; the boom being pivotally connected at its near end with the respective boom pivot point of the immediately preceding lever and near the remote end thereof, and having a remote lever pivot point that is pivotally connected at its remote end with the respective near end of the next connected lever; the next lever being pivotally connected at its near end with the remote end of the respective immediately preceding boom, having a near lever pivot point that is connected to the remote end of the immediately preceding lever, having a remote boom pivot point that is connected to the respective next boom and a remote lever pivot point that is connected to the next succeeding lever, the sequential levers following the first lever having substantially the same length between a near end pinning point, to near lever pivot point, to remote boom pivot point, to remote end lever pivot point and wherein all booms exclusive of said first boom have substantially the same length between the near end pinning point and the remote end pinning point, the remote end of all levers at the remote end lever pivot point being maintained nearer to the work tool at all positions than the near end pivot point of the same lever and nearer to the work tool than the boom pivot points on the levers; whereby load leverage moments are equalized at all pnning points; whereby lockup of extensible apparatus is prevented; and warehousing and assembly are facilitated;

g. a second extensible means for changing angles of said first boom and first lever with respect to said pivotally mounted support structure;

h. an ultimate lever having a near end connected with said remote lever pivot point of the preceding boom, having a remote end work tool pivot connection point for connections with the work tool and having an intermediate fulcrum pivot point connected with said remote lever pivot point of the preceding lever;

i. An ultimate boom having a near end pivotally connected with said intermediate boom pivot point of an immediately preceding lever and having a remote end work tool pivot connection point for connection with the work tool; and j. means for connecting the work tool with said remote ends of said ultimate boom and lever.

2. The extensible apparatus of claim 1 wherein there are respective pairs of said respective first booms and first levers and ultimate booms and levers for stability when reaching far.

3. The extensible boom apparatus of claim 2 wherein the work tool comprises a cargo lift and said means for connecting the work tool comprises respective work tool booms and levers connected intermediate said work tool and said ultimate levers and booms with said work tool boom being connected with said remote boom pivot point of the preceding lever and said work tool lever being pivotally connected at its near end with preceding boom and having an intermediate fulcrum pivot point that is connected with said remote lever pivot point of the preceding boom.

4. The extensible boom apparatus of claim 2 wherein said remote ends of said ultimate boom and lever are connected with a pivotally mounted link to maintain parallelogram relationship and said work tool comprises a pivotally mounted cargo lift fork means for lifting; said lift fork means being pivotally connected with at least of one of said remote ends of said ultimate boom and lever and said pivotally mounted link; and wherein an extensible means is connected intermediate said lift fork means and at least one of said ultimate boom and lever for tilting said lift fork means.

5. The extensible boom apparatus of claim 2 wherein said remote ends of said ultimate boom and lever are connected with a pivotally mounted link to maintain parallelogram relationship and said work tool comprises a pivotally mounted digger; said digger being pivotally connected with at least one of said remote ends of said ultimate boom and lever and said pivotally mounted links; and wherein an extensible means is connected intermediate said digger and at least one of said ultimate boom and lever for tilting said digger.

6. The extensible boom apparatus of claim 2 wherein said work tool comprises a pincer tool having a pair of pivotally connected jaws for gripping; said remote ends of said ultimate boom and lever are connected with one jaw and an extensible means for extending and retracting its connected end intermediate said jaws for effecting opening and closing of said jaws of said pincer.

7. The extensible apparatus of claim 2 wherein a second said pivotal support structure is pivotally connected with said remote ends of said ultimate booms and levers; and wherein there are provided a second extensible means for tilting said second pivotally mounted support structure; second respective pairs of first booms and levers; second respective pairs of extension units with their respective pairs of booms and levers; and second respective pairs of ultimate booms and levers; all being connected together for exceptional flexibility and reach.

8. The extensible apparatus of claim 1 wherein said remote ends of said ultimate boom and lever are connected with a pivotally mounted link to maintain parallelogram relationship and said work tool comprises a pivotally mounted cargo lift fork means for lifting; said lift fork means being pivotally connected with at least of one of said remote ends of said ultimate boom and lever and said pivotally mounted link; and wherein an extensible means is connected intermediate said lift fork means and at least one of said ultimate boom and lever for tilting said lift fork means.

9. The extensible apparatus of claim 1 wherein said remote ends of said ultimate boom and lever are connected with a pivotally mounted link to maintain parallelogram relationship and said work tool comprises a pivotally mounted digger; said digger being pivotally connected with at least one of said remote ends of said ultimate boom and lever and said pivotally mounted links; and wherein an extensible means is connected intermediate said digger and at least one of said ultimate boom and lever for tilting said digger.

10. The extensible apparatus of claim 1 wherein said work tool comprises a pincer tool having a pair of pivotally connected jaws for gripping; said remote ends of said ultimate boom and lever are connected with one jaw and an extensible means for extending and retracting its connected end intermediate said jaws for effecting opening and closing of said jaws of said pincer.

11. The extensible boom apparatus of claim 1 wherein said extensible means of elements d and f comprise fluid powered rams.

12. The extensible apparatus of claim 11 wherein said fluid powered rams comprise hydraulically operated rams.

13. The extensible apparatus of claim 1 wherein said means for connecting the work tool includes a short lever that is connected with both said remote ends of said ultimate boom and ultimate lever so as to keep a parallelogram relationship therebetween and also has a pivot connection point at its remote end for connection with said work tool.

14. An extensible apparatus adaptable for employing an end-use work tool for one of a multiple purposes and comprising:

a. a base;

b. a main support structure fixedly connected to said base;

c. at least one pair of respective first boom and first lever having their respective near ends pivotally connected with said support structure such that they can be pivoted to change their angle of support; said first boom having a remote lever pivot point near its remote end for connection with a subsequent lever; said first lever having a remote lever pivot point for connection with an intermediate fulcrum pivot point connection of a subsequent lever and having intermediate said near end and said remote pivot point an intermediate boom pivot point for connection with a subsquent boom;

d. extensible means for changing said angle of support of said first boom and first lever for effecting the extension and retraction of said extensible apparatus;

e. a plurality of extension units connected to said first boom and lever, each said extension unit comprising a next lever and next parallel boom; the boom being pivotally connected at its near end with the respective boom pivot point of the immediately preceding lever and near the remote end thereof, and having a remote lever pivot point that is pivotally connected at its remote end with the respective near end of the next connected lever; the next lever being pivotally connected at its near end with said remote end of the respective immediately preceding boom, having a near lever pivot point that is connected to the remote end of the preceding lever, having a remote boom pivot point that is connected to the respective next boom and a remote lever pivot point that is connected to the next succeeding lever; the sequential levers following the first lever having substantially the same length between a near end pinning point, to near lever pivot point to remote boom pivot, to remote end lever pivot point and wherein all booms exclusive of said first boom have substantially the same length between the near end pinning point and the remote end pinning point; the remote end of all levers at the remote end lever pivot point being maintained nearer to the work tool at all positions than the near end pivot point and nearer to the work tool than the boom pivot points on the levers whereby load leverage moments are equalized at all pinning points, thus preventing overloading and lockup and whereby warehousing and assembly are facilitated;

f. an ultimate lever having a near end pivotally connected with said remote lever pivot point of the immediately preceding boom, having a remote end work tool pivot connection point for connection with the work tool and having an intermediate fulcrum pivot point connected with the remote lever pivot point of the preceding lever;

g. an ultimate boom having a near end pivotally connected with said intermediate boom pivot point of an immediately preceding lever and having remote end work tool pivot connection for connection with the work tool; and h. means for connecting the work tool with said remote ends of said ultimate boom and lever.

15. The extensible apparatus of claim 14 wherein there are respective pairs of said respective booms and levers in all of said first booms and levers, next booms and levers of said extension units, and said ultimate booms and levers.

16. The extensible apparatus of claim 15 wherein said work tool comprises a cargo lift and said means for connecting the work tool comprise respective work tool booms and work tool levers connected intermediate said work tool and said ultimate levers and booms with said work tool boom being connected at its near end with said remote boom pivot point of the preceding lever and said work tool lever being pivotally connected at its near end with the preceding boom and having intermediate fulcrum pivot point that is connected with said remote lever pivot point of the preceding boom.

17. The extensible apparatus of claim 15 wherein said remote ends of said ultimate boom and lever are connected with a pivotally mounted link to maintain parallelogram relationships and said work tool comprises a pivotally mounted cargo lift fork means for lifting; said lift fork means being pivotally connected with at least one of said remote ends of said ultimate boom and lever and said pivotally mounted link; and wherein an extensible means is connected intermediate said lift fork means and at least one of said ultimate boom lever for tilting said lift fork means.

18. The extensible apparatus of claim 15 wherein said remote ends of said ultimate boom and lever are connected with a pivotally mounted link to maintain parallelogram relationship and said work tool comprises a pivotally mounted digger; said digger being pivotally connected with at least one of said remote ends of said ultimate boom and lever and said pivotally mounted link; and wherein an extensible means is connected intermediate said digger and at least one of said ultimate boom and lever for tilting said digger.

19. The extensible apparatus of claim 15 wherein said work tool comprises a pincer tool having a pair of pivotally connected jaws for gripping; wherein said remote ends of said ultimate boom and lever are connected with one jaw and an extensible means for extending and retracting is connected intermediate said jaws for effecting opening and closing of said jaws of said pincer.

20. The apparatus of claim 15 wherein said means for connecting the work tool includes a pair of short levers that are connected with both said remote ends of said respective pairs of ultimate boom and ultimate levers so as to keep a parallelogram relationship therebetween, and also has a pivot connection point at its remote end for connection with said work tool.

21. The extensible apparatus of claim 14 wherein said extensible means comprises a fluid powered ram.

22. The extensible apparatus of claim 21 wherein said fluid powered ram comprises a hydraulically operable ram.

23. The apparatus of claim 14 wherein a pivotal support structure is pivotally connected with said remote ends of said ultimate booms and levers; a second extensible means is provided for tilting said pivotally mounted support structure; wherein there are provided second respective pairs of first booms and levers, extension units with their respective booms and levers and respective pairs of ultimate booms and levers that are connected together for exceptional flexibility and reach.

24. A pivotally mounted, extensible apparatus adaptable for employing an end-use work tool for one of a multiple purposes, comprising:

a. a lower base plate that is fixedly connected to a stable platform;

b. a pivotally mounted upper base plate that is pivotally mounted on said lower base plate for 360° of rotation about a pivot shaft;

c. means for attaining and maintaining a given azimuth in said 360° rotation of said upper base plate with respect to said lower base plate;

d. a main support structure fixedly connected with said upper base plate;

e. at least one pair of respective first booms and first levers having their respective near ends pivotally connected with said support structure such that they can be pivoted and their support angle changed with respect to said support structure; each said first boom having a remote lever pivot point adjacent its remote end for connection with a subsequent lever; each said first lever having a remote lever pivot point for connection with a near intermediate fulcrum point connection of a subsequent lever and having intermediate said near end and said remote pivot point a remote intermediate boom pivot point for connection with a subsequent boom;

f. a plurality of extension units connected with said first levers and booms; each said extension unit comprising respective pairs of next levers and next booms, each said next boom being pivotally connected at its near end with the respective boom pivot point of the immediately preceding lever and near the remote end thereof, and having a remote lever pivot point that is pivotally connected at its remote end with the respective near end of the next connected lever, the next lever being pivotally connected at its near end with the remote end of the respective immediately preceding boom, having a near lever pivot point that is connected to the remote end of the immediately preceding lever, having a remote boom pivot point that is connected to the respective next boom and a remote lever pivot point that is connected to the next succeeding lever; the sequential levers following the first lever having substantially the same length between a near end pinning point, to near lever pivot point, to remote boom pivot point, to remote end lever pivot point and wherein all booms exclusive of said first boom have substantially the same length between the near end pinning point and the remote end pinning point, the remote end of all levers at the remote end lever pivot point being maintained nearer to the work tool at all positions than the near end pivot point of the same lever and nearer to the work tool than the boom pivot points on the levers; whereby load leverage moments are equalized at all pinning points; whereby lockup of extensible apparatus is prevented; and warehousing and assembly are facilitated;

g. extensible means for pivoting said first boom and lever for changing their angle with respect to said support structure;

h. at least one pair of ultimate levers each having a near end pivotally connected with said remote lever pivot point of the preceding boom, having a remote end work tool pivot connection point for connection with the work tool and having intermediate fulcrum pivot point connected with said remote lever pivot point of the preceding lever;

i. at least one pair of ultimate booms, each having a near end pivotally connected with said intermediate boom pivot point of an immediately preceding lever and having a remote end work tool pivot connection for connection with the work tool; and j. means for connecting the work tool with remote ends of said ultimate boom and lever.

25. The pivotally mounted extensible apparatus of claim 24 wherein a pivotally mounted support structure is pivotally mounted on said main support structure and is connected with at least one of said near ends of said first boom and lever such that pivoting said pivotally mounted support structure can change the respective angle of support of said first boom and first lever; and wherein a pivoting extensible means is provided for pivoting said pivotally mounted support structure so as to change its angle of support of said first boom and first lever.

26. The extensible apparatus of claim 25 wherein there are respective pairs of respective first booms and levers and ultimate booms and levers.

27. The pivotally mounted extensible apparatus of claim 26 wherein said remote ends of said ultimate boom and lever are connected with a pivotally mounted link to maintain parallelogram relationships and said work tool comprises a pivotally mounted cargo lift fork means for lifting; said lift fork means being pivotally connected with at least one of said remote ends of said ultimate boom and lever and said pivotally mounted link; and wherein an extensible means is connected intermediate said lift fork means and at least one of said ultimate boom lever for tilting said lift fork means.

28. The pivotally mounted extensible apparatus of claim 26 wherein said remote ends of said ultimate boom and lever are connected with a pivotally mounted link to maintain parallelogram relationship and said work tool comprises a pivotally mounted digger; said digger being pivotally connected with at least one of said remote ends of said ultimate boom and lever and said pivotally mounted link; and wherein an extensible means is connected intermediate said digger in at least one of said ultimate booms and levers for tilting said digger.

29. The pivotally mounted extensible apparatus of claim 26 wherein said work tool comprises a pincer tool having a pair of pivotally connected jaws for gripping; wherein said remote ends of said ultimate boom and lever are connected with one jaw and an extensible means for extending and retracting is connected intermediate said jaws for effecting opening and closing of said jaws of said pincer.

30. The pivotally mounted extensible apparatus of claim 26 wherein said extensible means comprises a fluid powered ram.

31. The extensible apparatus of claim 30 wherein said fluid powered ram comprises a hydraulically operable ram.

32. The apparatus of claim 26 wherein a pivotal support structure is pivotally connected with said remote ends of said ultimate booms and levers; a second extensible means is provided for tilting said pivotally mounted support structure; wherein there are provided second respective pairs of first booms and levers, extension units with their respective boom and levers and respective pairs of ultimate booms and levers that are connected together for exceptional flexibility and reach.

33. The pivotally mounted extensible apparatus of claim 26 wherein said means for connecting the work tool includes a short lever at each end that is connected with both said remote ends of said respective pairs of ultimate boom and ultimate levers so as to keep a parallelogram linkage relationship therebetween and each short lever also has a pivot connection point at each remote end for connection with said work tool.

34. The pivotally mounted extensible apparatus of claim 24 wherein the 360° of rotation capability is effected by a 360° pinion rack and an engaging pinion gear powered by a fluid powered motor; one of said 360° pinion rack and the engaging pinion gear being connected with said lower base plate and the other thereof being connected with said upper base plate.

35. The pivotally mounted extensible apparatus of claim 34 wherein said fluid powered motor comprises a hydraulically powered hydrostatic motor.

36. The extensible boom of claim 1 or 14 or 24 wherein the extensible means includes an extensible means coupled between a pair of lever sections such that when activated will effect extension or retraction of the extensible apparatus.

* * * * *